United States Patent [19]

Aiba

[11] Patent Number: 4,652,222

[45] Date of Patent: Mar. 24, 1987

[54] RIPPLE REGULATING SYSTEM IN A LIQUID SUPPLY SYSTEM

[75] Inventor: Masahiko Aiba, Nara, Japan

[73] Assignee: Sharp Kabushiki Kaisha, Osaka, Japan

[21] Appl. No.: 366,705

[22] Filed: Apr. 8, 1982

[30] Foreign Application Priority Data

Apr. 22, 1981 [JP] Japan ..... 56-61834

[51] Int. Cl.[4] ..... F04B 11/00

[52] U.S. Cl. ..... 417/540; 137/568; 138/31

[58] Field of Search ..... 417/540, 542, 543, 254, 417/265, 328; 137/568; 138/26, 30, 31; 318/640

[56] References Cited

U.S. PATENT DOCUMENTS

| | | | |
|---|---|---|---|
| 3,080,708 | 3/1963 | Carr | 60/39.091 X |
| 3,456,673 | 7/1969 | Legrand | 138/30 X |
| 3,720,487 | 3/1973 | Wiley | 138/31 X |
| 3,868,972 | 3/1975 | Zirps | 138/30 |
| 4,161,964 | 7/1979 | Greiner et al. | 138/30 X |

FOREIGN PATENT DOCUMENTS

| | | | |
|---|---|---|---|
| 2025089 | 1/1980 | United Kingdom | 318/640 |

*Primary Examiner*—Carlton R. Croyle
*Assistant Examiner*—Donald E. Stout
*Attorney, Agent, or Firm*—Birch, Stewart, Kolasch & Birch

[57] ABSTRACT

A ripple regulating system is disposed in a liquid supply system for minimizing pressure ripples generated by a pump employed in the liquid supply system. The ripple regulating system includes a pressure chamber of which one wall comprises a bellowphragm. A spring is secured to the bellowphragm to apply a predetermined pressure to the pressure chamber. A detection system is associated with the pressure chamber for detecting a balance pressure variation. When the balance pressure becomes higher than the preselected level, an adjusting system is operated to increase the depression pressure generated by the spring, thereby maintaining the constant flow rate supply.

7 Claims, 6 Drawing Figures

RIPPLE REGULATING SYSTEM IN A LIQUID SUPPLY SYSTEM

BACKGROUND AND SUMMARY OF THE INVENTION

The present invention relates to a liquid supply system and, more particularly, to a ripple regulating system for removing pressure ripples generated by a pump included in the liquid supply system.

The present invention provides an ink liquid supply system in an ink jet system printer of the charge amplitude controlling type for ensuring a constant flow rate of the ink liquid.

Generally, when a piston activated pump is employed in a liquid supply system, pressure ripples are generated in the liquid. The thus generated pressure ripples adversely influence the constant flow rate supply. The constant flow rate supply is very important especially in an ink jet system printer of the charge amplitude controlling type to achieve correct and clean printing.

Therefore, a ripple regulator is usually disposed in the liquid supply system. However, the conventional ripple regulator is not satisfactory because the conventional ripple regulator cannot minimize the pressure ripples in a short response time.

Accordingly, an object of the present invention is to provide a novel ripple regulating system for use in a liquid supply system.

Another object of the present invention is to shorten the response time of a ripple regulating system in a liquid supply system which includes a piston activated pump.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, one wall of a ripple regulator is formed by a bellowphragm. A depression mechanism is associated with the bellowphragm in order to apply a preselected pressure to the ripple regulator. A balance pressure detection system is provided for varying the depression pressure of the depression mechanism in response to the variation of the balance pressure.

BRIEF DESCRIPTION OF THE DRAWINGS

The present invention will be better understood from the detailed description given hereinbelow and the accompanying drawings which are given by way of illustration only, and thus are not limitative of the present invention and wherein.

DESCRIPTION OF THE PREFERRED EMBODIMENTS

In a liquid supply system including a piston activated pump system, pressure ripples are inevitably generated due to the piston movement. The pressure ripples must be minimized when the liquid supply system is designed to operate as a constant flow rate liquid supply system. The constant flow rate supply is very important in, for example, an ink jet system printer of the charge amplitude controlling type.

Figure 6:
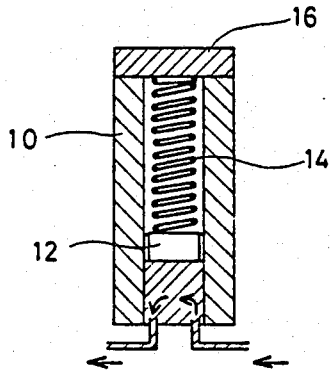
FIG.6 PRIOR ART
FIG. 6 is a sectional view of a ripple regulator of the prior art.

In order to minimize the pressure ripples, a ripple regulator is usually provided in the liquid supply system. FIG. 6 shows a typical construction of the conventional ripple regulator employed in the liquid supply system for the ink jet system printer of the charge amplitude controlling type. The conventional ripple regulator of FIG. 6 includes a cylinder 10, and a piston 12 slidably disposed in the cylinder 10. A spring 14 is disposed between the piston 12 and a cylinder head 16 to absorb the pressure ripples.

The ripple pressure $P_{RP}$ in the ripple regulator and the pressure response time T of the ripple regulator can be expressed as follows:

$$P_{RP}=K_1\cdot(k/S^2)$$

$$T=K_2\cdot(S^2/K)$$

where:

k is the spring constant of the spring 14;

S is the size of the piston 12; and $K_1$ and $K_2$ are constants.

It will be clear that the ripple pressure $P_{RP}$ is reduced as the spring constant k is small and the piston size S is large.

On the other hand, the pressure response time T should be short in order to ensure the constant flow rate supply. When, for example, the ambient temperature varies, the liquid viscosity varies. Thus, the balance pressure in the liquid supply system varies depending on the ambient temperature. Therefore, the ripple regulator must rapidly respond to the variation of the balance pressure. The pressure response time T represents a response time in which the size of the pressure chamber of the ripple regulator is varied in response to the variation of the mean pressure of the liquid introduced into the ripple regulator in order to maintain the constant flow rate supply. The pressure response time T is lengthened as the spring constant k is reduced and the piston size S is increased.

Accordingly, in the conventional ripple regulator, it is impossible to reduce the ripple pressure $P_{RP}$ without lengthening the pressure response time T.

In accordance with the present invention, the spring constant k is selected to be small so as to minimize the ripple pressure $P_{RP}$. Furthermore, a novel system is associated with the ripple regulator to shorten the pressure response time T.

Figure 1:
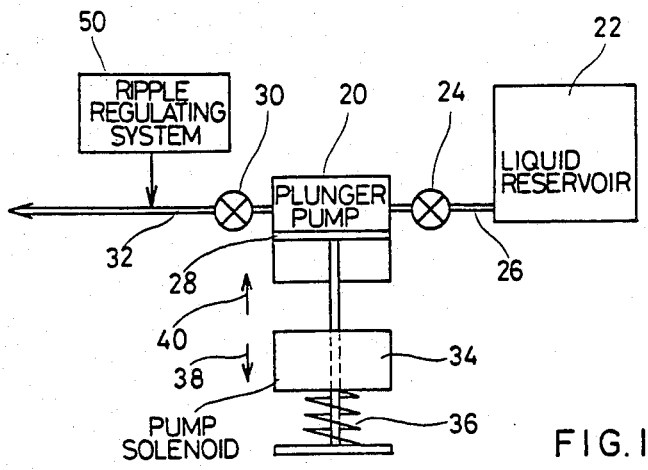
FIG. 1 is a schematic block diagram of a liquid supply system including a ripple regulating system of the present invention.

FIG. 1 shows a liquid supply system employing an embodiment of a ripple regulating system of the present invention. A plunger pump 20 is connected to a liquid reservoir 22 via an inlet valve 24 and a conduit 26. The liquid contained in the liquid reservoir 22 is introduced into the plunger pump 20 through the inlet valve 24 in response to the movement of a piston 28, and output through an outlet valve 30 and a conduit 32. The piston 28 is secured to a plunger of a pump solenoid 34. The plunger of the pump solenoid 34 is pulled by a spring 36 in a direction shown by an arrow 38.

Accordingly, when the pump solenoid 34 is activated, the piston 28 is driven to shift in a direction shown by an arrow 40, thereby developing or outputting the liquid via the outlet valve 30 and the conduit 32. The thus developed liquid flow includes pressure ripples due to the movement of the piston 28. A ripple regulating system 50 of the present invention is disposed at the downstream of the outlet valve 30 in order to minimize the pressure ripples generated by the movement of the piston 28.

Figure 2:
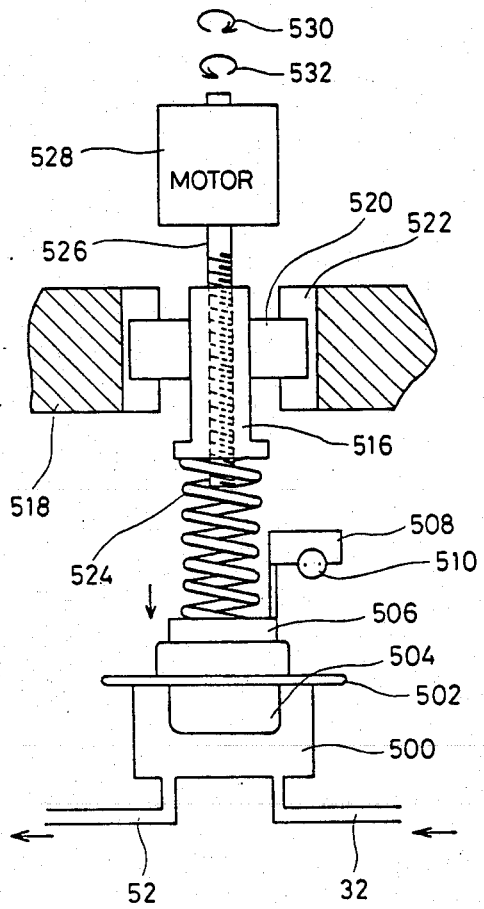
FIG. 2 is a sectional view of an embodiment of a ripple regulating system of the present invention.

FIG. 2 shows a construction of the ripple regulating system 50. The ripple regulating system 50 includes a pressure chamber 500 which is communicated with the above-mentioned outlet valve 30 of the plunger pump 20 through the conduit 32. The liquid contained in the pressure chamber 500 is supplied to a desired unit such as an ink droplet issuance unit through a conduit 52. The pressure chamber 500 has an open free end at the upper section thereof. The open free end is covered by a flange 502 of a bellowphragm 504 in order to seal the pressure chamber 500. A cap 506 is secured to the bellowphragm 504.

Figure 3:
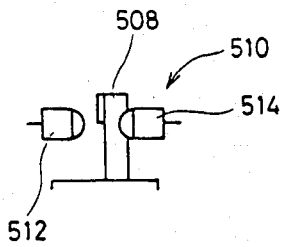
FIG. 3 is a front view of a balance pressure detection system included in the ripple regulating system of FIG. 2.

A shutter 508 is secured to the cap 506. An optical sensor 510 is associated with the shutter 508 in order to detect the location of the shutter 508. The optical sensor 510 includes a light emitting diode 512 and a phototransistor 514. The shutter 508 is disposed between the light emitting diode 512 and the phototransistor 514 as shown in FIG. 3. The shutter 508 and the optical sensor 510 function, in combination, to detect the balance pressure in the pressure chamber 500. More specifically, the shutter 508 is moved up-and-down in unison with the shift movement of the bellowphragm 504. Therefore, the amount of light from diode 512 reaching the phototransistor 514 varies in response to the shift movement of the bellowphragm 504.

The ripple regulating system 50 further includes a slider 516 slidably secured to a housing 518 through the use of a guide leaf 520 which is coupled to a guide groove 522 formed in the housing 518. A spring 524 is disposed between the slider 516 and the cap 506 in order to depress the bellowphragm 504 at a predetermined pressure. A threaded hole is formed through the slider 516 through which a threaded shaft 526 is disposed. One end of the threaded shaft 526 is secured to a drive shaft of a motor 528 which is secured to the housing of the liquid supply system.

When the drive shaft of the motor 528 is rotated in a direction shown by an arrow 530, the slider 516 is shifted downward, thereby increasing the pressure applied by the spring 524 to the pressure chamber 500 via the bellowphragm 504. When the drive shaft of the motor 528 is rotated in a direction shown by an arrow 532, the slider 516 is shifted upward. Therefore, the pressure applied to the pressure chamber 500 is reduced.

When the pressure in the liquid are introduced into the pressure chamber 500 through the conduit 32, the bellowphragm 504 moves up-and-down depending on the pressure ripples. That is, the spring 524 functions to absorb the pressure ripples. Since the spring constant k of the spring 524 is made small, the ripple pressure $P_{RP}$ is minimized to a desired degree. However, as already discussed above, the small spring constant k will function to lengthen the response time T when the balance pressure varies. The long response time is caused by the variation of the mean location of the belowphragm 504 depending on the balance pressure variation. Therefore, in accordance with the present invention, the system is constructed so that the bellowphragm 504 responds to high frequency ripples (1 Hz through 5 Hz) but does not respond to low frequency ripples (below 1 Hz).

Figure 4:
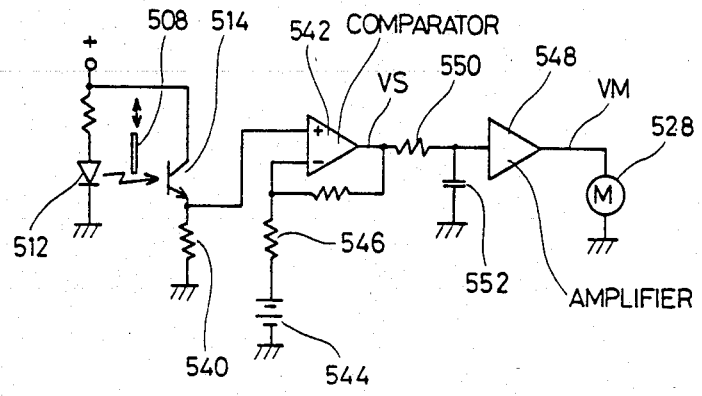
FIG. 4 is a circuit diagram of an embodiment of a depression pressure controlling system associated with the ripple regulating system of FIG. 2.

FIG. 4 shows a control circuit for conducting the above-mentioned preferred operation. Like elements corresponding to those of FIGS. 2 and 3 are indicated by like numerals.

The collector current of the phototransistor 514 varies depending on the location of the shutter 508. The collector current of the phototransistor 514 flows through a resistor 540, whereby a voltage signal is applied to one input terminal of a comparator 542. A reference voltage signal is applied from a battery 544 to the other input terminal of the comparator 542 via a resistor 546. An output VS of the comparator 542 represents the level of the voltage signal derived from the collector current of the phototransistor 514. More specifically, when the voltage signal derived from the collector current of the phototransistor 514 is greater than the reference voltage signal, that is, when the shutter 508 is shifted upward to increase the light amount supplied to the phototransistor 514, the output VS is positive. Contrarily, when the voltage signal derived from the collector current of the phototransistor 514 is lower than the reference voltage signal, that is, when the shutter 508 is shifted downward to reduce the light amount supplied to the phototransistor 514, the output VS is negative.

The output VS developed from the comparator 542 is applied to a power amplifier 548 via a lowpass filter including a resistor 550 and a capacitor 552. An output signal VM of the power amplifier 548 is applied to the motor 528.

Figure 5:
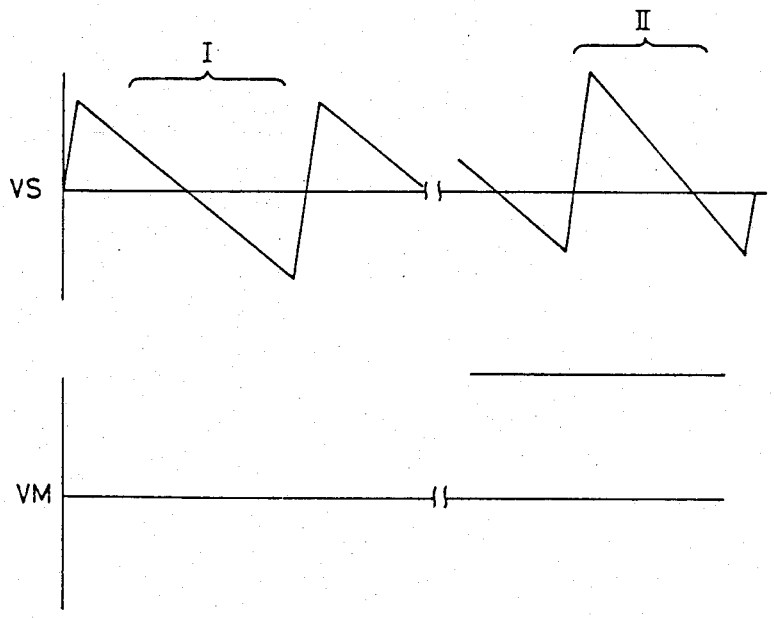
FIG. 5 is a time chart showing signals occurring within the depression pressure controlling system of FIG. 4.

FIG. 5 shows the output VS developed from the comparator 542 and the output signal VM developed from the power amplifier 548. If the system is placed in a desired operating condition, the output VS of the comparator 542 varies as shown in a section I of FIG. 5. When the thus developed output VS is passed through the lowpass filter implemented with the resistor 550 and the capacitor 552, the positive part and the negative part function to cancel each other. Therefore, the output signal VM of the power amplifier 548 is zero and does not rotate the motor 528. If the viscosity of the liquid becomes high due to the variation of the ambient condition, the mean level of the collector current flowing through the phototransistor 514 increases. Accordingly, the output VS of the comparator 542 deviates toward the positive level as shown in a section II of FIG. 5. Therefore, the power amplifier 548 develops a positive output signal VM to rotate the motor 528 in the direction shown by the arrow 530.

That is, when the viscosity of the liquid is increased and the mean location of the shutter 508 is shifted upward, the motor 528 is rotated in the direction shown by the arrow 530, whereby the slider 516 is shifted downward to return the mean location of the bellowphragm 504 to the desired position. The motor rotation is terminated when the output VS of the comparator 542 shows the waveform as shown in the section I of FIG. 5, wherein the desired constant flow rate supply is achieved. Contrarily, when the viscosity of the liquid is reduced, the mean location of the shutter 508 is shifted downward. Thus, the output VS of the comparator 542 deviates toward the negative level, whereby the power amplifier 548 develops a negative output signal VM. The motor 528 is rotated in the direction shown by the arrow 532 to increase the volume of the pressure chamber 500, thereby maintaining the volume of the pressure chamber 500 at a desired size.

The invention being thus described, it will be obvious that the same may be varied in many ways. Such variations are not to be regarded as a departure from the spirit and scope of the invention, and all such modifications are intented to be included within the scope of the following claims.

What is claimed is:

1. In a liquid supply system including a pump system, a regulating system for minimizing pressure ripples generated by said pump system and for ensuring a substantially constant liquid flow rate, said regulating system comprising:

a ripple regulator including:

a pressure chamber;

a first opening in said chamber for defining inlet means for introducing the liquid developed from said pump system into said pressure chamber; a second opening in said chamber for defining outlet means for developing the liquid from said pressure chamber;

a resilient member secured to said pressure chamber for permitting variations in the volume of said pressure chamber; and resilient depression means connected to said resilient member for pressing said resilient member inward of said pressure chamber with a predetermined pressure;

detection means for detecting variations of balance pressure in said pressure chamber and for developing detection output signals in response to said variations; and adjusting means for adjusting said pressure generated by said depression means in response to said detection output signals developed from said detection means.

2. The regulating system of claim 1, wherein said resilient member comprises a bellowphragm.

3. The regulating system of claim 2, wherein said depression means comprises a spring secured to said bellowphragm.

4. The regulating system of claim 3, wherein said adjusting means comprises:

a movable member secured to an end of said spring opposite from said bellowphragm; and means for shifting said movable member in response to said detection output signals developed from said detection means.

5. The regulating system of claim 1, 2, 3 or 4, wherein said detection means comprises:

a shutter secured to said resilient member; and shutter position detection means for detecting the location of said shutter and for developing said detection output signals in response to the detected location of said shutter.

6. The regulating system of claim 5, wherein said shutter position detection means comprises:

a light emitting element; and a phototransistor, wherein said shutter is disposed in the light path from the light emitting element to the phototransistor.

7. The regulating system of claim 6, wherein said detection means comprises:

a comparator for comparing a voltage signal derived from said phototransistor with a reference voltage signal;

a lowpass filter for averaging an output signal of said comparator; and an amplifier connected to said lowpass filter, wherein an output signal of said amplifier is applied to said adjusting means.

* * * * *